US008702374B2

(12) United States Patent
Butler

(10) Patent No.: US 8,702,374 B2
(45) Date of Patent: Apr. 22, 2014

(54) GAS TURBINE ENGINE

(75) Inventor: David Butler, Lincoln (GB)

(73) Assignee: Siemens Aktiengesellschaft, Munich (DE)

( * ) Notice: Subject to any disclaimer, the term of this patent is extended or adjusted under 35 U.S.C. 154(b) by 532 days.

(21) Appl. No.: 13/015,699

(22) Filed: Jan. 28, 2011

(65) Prior Publication Data

US 2012/0195737 A1 Aug. 2, 2012

(51) Int. Cl.
*F04D 29/08* (2006.01)

(52) U.S. Cl.
USPC ..... 415/115; 416/97 R

(58) Field of Classification Search
USPC ..... 415/173.3, 209.2, 190, 191, 115, 173.7, 415/174.3; 416/219 R, 220 R
See application file for complete search history.

(56) References Cited

U.S. PATENT DOCUMENTS 4,815,933 A 3/1989 Hansel et al.
4,883,405 A 11/1989 Walker
5,609,466 A * 3/1997 North et al. ..... 415/115
5,618,161 A * 4/1997 Papageorgiou et al. ..... 415/190
5,797,723 A 8/1998 Frost et al.
2006/0127212 A1* 6/2006 Durocher et al. ..... 415/116
2007/0284832 A1* 12/2007 Wunderlich et al. ..... 277/594
2009/0110549 A1 4/2009 Snook et al.
2009/0169360 A1* 7/2009 Broomer et al. ..... 415/115
2009/0169361 A1* 7/2009 Cole et al. ..... 415/115
2009/0169369 A1 7/2009 Morgan et al.

FOREIGN PATENT DOCUMENTS

EP 1340885 A2 9/2003

* cited by examiner

*Primary Examiner* — Nathaniel Wiehe
*Assistant Examiner* — Eldon Brockman

(57) ABSTRACT

A gas turbine engine including a segment of an annular guide vane assembly is provided. When the engine is used, the segment directs hot combustion gases onto rotor blades of the engine. The segment includes a platform disposed at a side of the segment radially inward/outward with respect to the axis of rotation of the engine. The platform has a trailing edge portion downstream with respect to the flow of hot combustion gases through the segment, the trailing edge portion includes a rail that extends radially inwardly/outwardly from the trailing edge portion. The engine also includes a support and cooling arrangement for supporting the segment and directing a cooling fluid to cool the segment. The arrangement is located radially inward/outward of the platform, and includes a flange part that extends radially outwardly/inwardly from the arrangement. The arrangement further includes a leaf seal and a retaining pin.

10 Claims, 1 Drawing Sheet

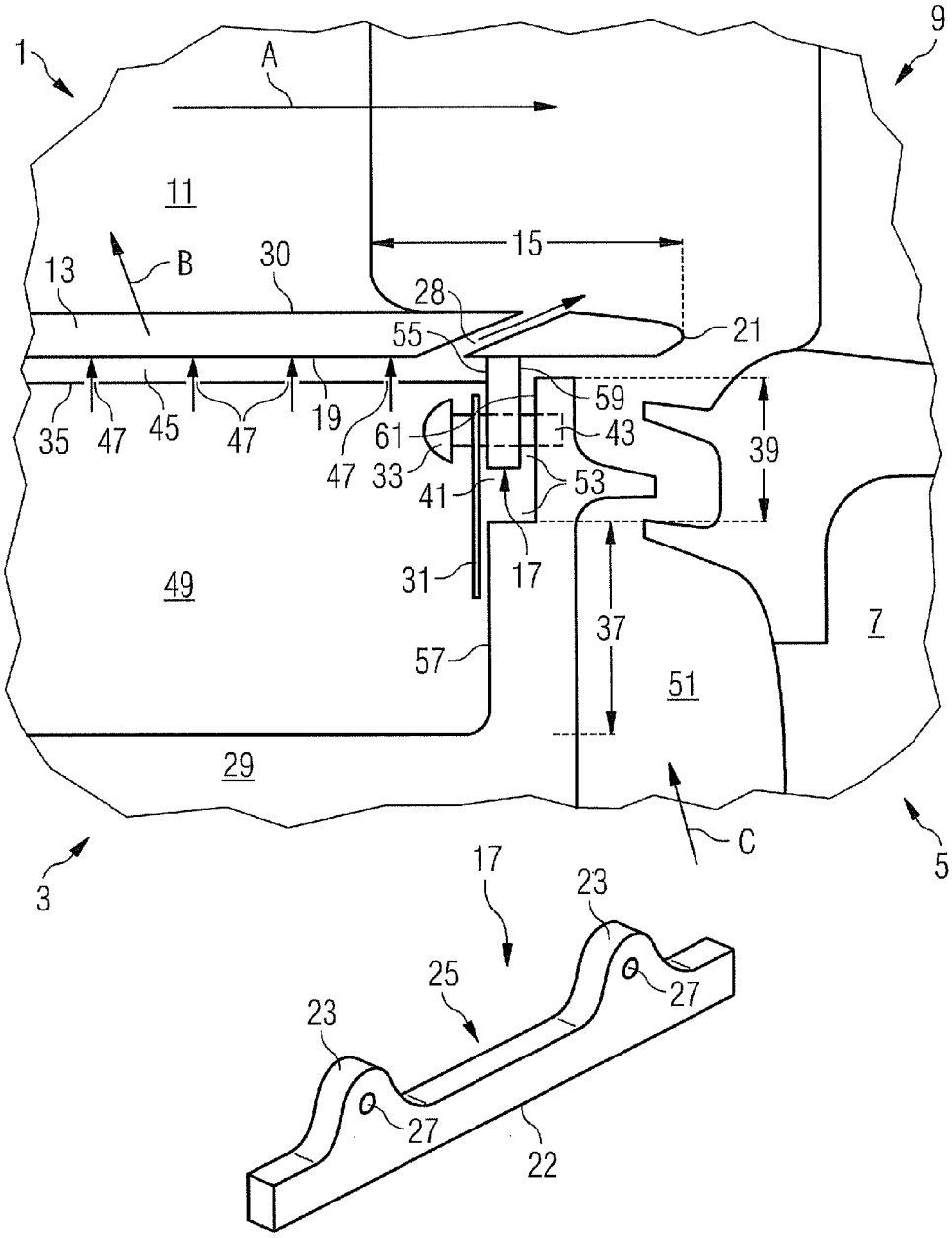
1
9
A
11
15
13
B
30
28
21
55
59
35
47
45
47
19
61
43
39
47
33
41
53
17
31
49
37
7
57
51
29
C
3
5
17
23
25
27
23
27
22

GAS TURBINE ENGINE

FIELD OF INVENTION

The present invention relates to a gas turbine engine.

BACKGROUND OF INVENTION

More particularly the present invention relates to a gas turbine engine including a segment of an annular guide vane assembly, in use of the engine the segment directing hot combustion gases onto rotor blades of the engine, the segment including a platform disposed at a side of the segment radially inward/outward with respect to the axis of rotation of the engine, the platform having a trailing edge portion downstream with respect to the flow of hot combustion gases through the segment, the trailing edge portion including a rail that extends radially inwardly/outwardly from the trailing edge portion, the engine also including a support and cooling arrangement for supporting the segment and directing a cooling fluid to cool the segment, the arrangement being located radially inward/outward of the platform, the arrangement including a flange part that extends radially outwardly/inwardly from the arrangement.

It is desired to simplify gas turbine engines of this kind.

SUMMARY OF INVENTION

According to the present invention there is provided a gas turbine engine including a segment of an annular guide vane assembly, in use of the engine the segment directing hot combustion gases onto rotor blades of the engine, the segment including a platform disposed at a side of the segment radially inward/outward with respect to the axis of rotation of the engine, the platform having a trailing edge portion downstream with respect to the flow of hot combustion gases through the segment, the trailing edge portion including a rail that extends radially inwardly/outwardly from the trailing edge portion, the engine also including a support and cooling arrangement for supporting the segment and directing a cooling fluid to cool the segment, the arrangement being located radially inward/outward of the platform, the arrangement including a flange part that extends radially outwardly/inwardly from the arrangement, characterised in that the arrangement further includes a leaf seal and at least one retaining pin, the retaining pin(s) extending through the leaf seal, the rail, and the flange part, thereby (i) to secure the segment to the arrangement to determine the radial position of the segment, and (ii) to retain the leaf seal in a position to seal an interface between the rail and the flange part against the ingress of cooling fluid.

BRIEF DESCRIPTION OF THE DRAWINGS

The invention will now be described, by way of example, with reference to the accompanying drawing, which is a diagrammatic illustration of a part of a gas turbine engine according to the present invention.

DETAILED DESCRIPTION OF INVENTION

Referring to the drawing, the part of the gas turbine engine comprises a segment 1 of an annular guide vane assembly of the engine, a support and cooling arrangement 3, and a rotor 5. The axis of rotation of the engine would run horizontally in the drawing and would be disposed below that shown in the drawing. Rotor 5 includes rotor blades 9 having blade roots 7.

Rotor 5 also includes a rotor disk (not shown) to which rotor blades 9 are secured by means of their blade roots 7. Segment 1 directs hot combustion gases travelling as indicated by arrow A in the drawing, onto rotor blades 9. It can be seen that the drawing shows only the radially inner and rearward part of segment 1, only the radially outer and rearward part of support and cooling arrangement 3, and only the radially inner and forward part of rotor blades 9 including their blade roots 7.

Segment 1 includes a guide vane 11 and a platform 13 at the radially inward side of segment 1. Segment 1 may further include one or more additional guide vanes 11, and a platform at the radially outward side of segment 1. All the guide vanes would extend radially between the radially inner and outer platforms. The radially inner and outer platforms would be arcuate in form. The view of segment 1 shown in the drawing is that seen looking in a circumferential direction.

As is known in the art, the complete annular guide vane assembly comprises a number of segments 1 arranged in a ring or annulus. Thus, in the drawing the plane of the annulus is a vertical plane perpendicular to the plane of the paper—there are segments 1 adjacent to and extending contiguous with the segment 1 shown in the drawing both below and above the plane of the paper (i.e. in the circumferential direction).

Platform 13 has a trailing edge portion 15 downstream with respect to the flow A of hot combustion gases through segment 1. Trailing edge portion 15 includes a rail 17 that extends radially inwardly from portion 15, from the radially inwardly directed face 19 of platform 13.

Rail 17 is shown in perspective at the bottom of the drawing. In this perspective view rail 17 is upside down as compared to its orientation above in the drawing. Rail 17 runs along trailing edge portion 15, parallel to the final trailing tip 21 of portion 15. Thus, rail 17 runs circumferentially in the engine. The circumferential extent of rail 17 is substantially the same as that of platform 13. Although rail 17 is shown as straight in the perspective view it is in fact slightly curved so that its base 22 sits in abutting relationship along its length with radially inwardly directed face 19 of platform 13 (platform 13 is of course slightly curved so as to extend circumferentially and have a radius, as is known in the art). The height of rail 17 is not the same along its length—rail 17 includes a raised portion 23 at each end and a depression 25 between portions 23. Portions 23 include holes 27. Depression 25 makes it easier for rail 17 to flex with flexing of platform 13.

Trailing edge portion 15 includes a channel 28 that extends in a generally downstream direction from radially inwardly directed face 19 of platform 13 to radially outwardly directed face 30 of platform 13.

Support and cooling arrangement 3 supports segment 1 and directs a cooling fluid to cool segment 1. Arrangement 3 is located radially inward of platform 13. Arrangement 3 comprises a carrier ring 29, a metal leaf seal 31, two retaining pins 33 (only one of which is shown in the drawing), and a cooling plate 35.

Carrier ring 29 includes a flange part comprising main and subsidiary flanges 37, 39 that extend radially outwardly from carrier ring 29. The reduced thickness of subsidiary flange 39 as compared to main flange 37 creates a recessed area 41 that runs around the periphery of carrier ring 29. Carrier ring 29, including its flanges 37, 39, is centred on the axis of rotation of the engine. In the drawing the plane of carrier ring 29 is a vertical plane perpendicular to the plane of the paper.

Leaf seal 31 extends into and out of the paper, and has a length substantially the same as rail 17 of segment 1.

Retaining pins 33 extend through leaf seal 31, then through holes 27 in raised portions 23 of rail 17, and then into holes 43 in subsidiary flange 39 (holes 43 in subsidiary flange 39 corresponding in position to holes 27 in rail 17). Pins 33 have an interference fit with one of rail 17 and subsidiary flange 39, and have a tight fit, less tight than an interference fit, with the other of rail 17 and subsidiary flange 39. Pins 33 have a relatively loose fit with leaf seal 31.

Cooling plate 35 is disposed just below and parallel to radially inwardly directed face 19 of platform 13, thereby to form a cooling channel 45 between plate 35 and face 19. Segment 1 includes a further rail (not shown) parallel to rail 17 that extends radially inwardly from a leading edge portion (not shown) of platform 13. The downstream end of cooling plate 35 locates into rail 17 and the upstream end of the plate (not shown) locates into the further rail. Cooling plate 35 includes a number of cooling holes 47.

Cooling fluid is supplied to a cavity 49 present between carrier ring 29 and segment 1 upstream of main and subsidiary flanges 37, 39, rail 17, leaf seal 31, and retaining pins 33. Radially outwardly directed jets of cooling fluid are formed by cooling holes 47 in cooling plate 35. These jets impinge upon and cool radially inwardly directed face 19 of platform 13. Some of the cooling fluid in cooling channel 45 travels through platform 13 to the interior of guide vane 11, as indicated by arrow B, and some travels via channel 28 in trailing edge portion 15 to film cool that part of radially outwardly directed face 30 of platform 13 downstream of the exit from channel 28. In addition, cooling fluid is supplied to a region 51 between carrier ring 29 and rotor blades 9, as indicated by arrow C. This fluid travels generally upwards in the drawing to join the fluid that leaves channel 28.

Retaining pins 33 are dual function: they both (i) secure segment 1 to carrier ring 29 to determine the radial position of segment 1, and (ii) retain leaf seal 31 in a position to seal the interface 53 between rail 17 and flanges 37, 39 against the ingress of cooling fluid from cavity 49. This dual function on the part of retaining pins 33 simplifies the form of the engagement between segment 1 and support and cooling arrangement 3. Further, advantageously, leaf seal 31 achieves the sealing of interface 53 without appreciably adding to the stiffness of platform 13.

Rail 17 runs along circumferentially extending recessed area 41, and upstream directed face 55 of rail 17 lies flush with (in the same plane as) upstream directed face 57 of main flange 37. Planar leaf seal 31 lies against flush faces 55 and 57 and bridges interface 53 between rail 17 and flanges 37, 39. Downstream directed face 59 of rail 17 opposes upstream directed face 61 of subsidiary flange 39.

The diameter of holes 27 in rail 17 and holes 43 in subsidiary flange 39 corresponds to the diameter of the shafts of retaining pins 33, and so the form of holes 27, 43 is such as to determine not only the radial but also the circumferential position of segment 1. If it is desired to permit adjustment of the circumferential position of segment 1 then this can be achieved by holes 27, 43 in rail 17 and/or subsidiary flange 39 comprising circumferentially extending slots. The radial and circumferential position of segment 1 can be determined, and yet circumferential thermal growth of segment 1 not constrained, by: the holes 27, 43 in respect of one of the two retaining pins 33 having diameters corresponding to the diameter of the shafts of the retaining pins, and either or both of the holes 27, 43 in respect of the other of the two retaining pins 33 comprising circumferentially extending slots.

The above description concerns a platform of a segment of an annular guide vane assembly, wherein the platform is disposed at the radially inward side of the segment. It is to be appreciated that the present invention could also be used in respect of a platform of a segment of an annular guide vane assembly, wherein the platform is disposed at the radially outward side of the segment. An example of this would be as follows: (a) a support and cooling arrangement analogous to arrangement 3 would be located radially outward of the platform and would include flanges analogous to flanges 37, 39 that extend radially inwardly from the arrangement, and (b) the trailing edge portion of the platform would include a rail analogous to rail 17 that extends radially outwardly from the trailing edge portion.

The above description concerns a segment of an annular guide vane assembly wherein a number of the segments are arranged in a ring or annulus to construct the complete annular guide vane assembly. It is to be understood that in a limiting case the segment may be the complete annular guide vane assembly in that only one segment is required to construct the complete annular guide vane assembly, i.e. the complete annular guide vane assembly is made up of only one segment that is itself a full ring or annulus.

I claim:

1. A gas turbine engine, comprising:

a segment of an annular guide vane assembly, comprising:

a platform disposed at a side of the segment radially inward with respect to an axis of rotation of the gas turbine engine; and a support and cooling arrangement for supporting the segment and directing a cooling fluid to cool the segment, comprising:

a flange part that extends radially inwardly from the support and cooling arrangement, a leaf seal, and a retaining pin, the retaining pin extending through the leaf seal, a rail, and the flange part, wherein when the gas turbine engine is in use, the segment directs hot combustion gases onto a plurality of rotor blades of the engine, wherein the platform includes a trailing edge portion downstream with respect to a flow of hot combustion gases through the segment, wherein the trailing edge portion includes the rail that extends radially inwardly from the trailing edge portion such that the rail abuts the radially inwardly directed face of the platform and is parallel to the final trailing tip of the trailing edge portion, wherein the support and cooling arrangement is located radially inward of the platform, and wherein the retaining pin secures the segment to the support and cooling arrangement to determine the radial position of the segment, and retains the leaf seal in a position to seal an interface between the rail and the flange part against the ingress of cooling fluid, wherein the support and cooling arrangement further includes a carrier ring centered on the axis of rotation of the engine, wherein the flange part comprises main and subsidiary flanges that extend radially outwardly from the carrier ring, wherein the subsidiary flange is of reduced thickness as compared to the main flange so as to create a recessed area that runs around a periphery of the carrier ring, wherein the rail runs along the circumferentially extending recessed area, wherein a first upstream directed face of the rail lies substantially in a same plane as a second upstream directed face of the main flange, and wherein the leaf seal is planar in form and lies against the first and second upstream directed faces and bridges the interface between the rail and the main and subsidiary flanges.

2. The gas turbine engine according to claim 1, further comprising two or more retaining pins.

3. The gas turbine engine according to claim 2, wherein the two or more retaining pins extend through a plurality of holes in the rail and flange part, the form of which is such as to determine a circumferential position of the segment.

4. The gas turbine engine according to claim 2, wherein the two or more retaining pins extend through circumferentially extending slots in the rail and/or flange part thereby to permit adjustment of a circumferential position of the segment.

5. The gas turbine engine according to claim 1, wherein the support and cooling arrangement further includes a cavity to which the cooling fluid is supplied, the cavity residing between the carrier ring and the segment upstream of the main and subsidiary flanges, the rail, the leaf seal, and the retaining pins.

6. The gas engine according to claim 5, wherein the trailing edge portion further includes a first channel that extends in a generally downstream direction from a radially inwardly directed face of the platform to a radially outwardly directed face of the platform, and wherein when the gas turbine engine is in use, the engine cooling fluid supplied to the cavity enters the first channel, travels along the first channel in a generally downstream direction, and leaves the first channel to film cool a part of the radially outwardly directed face downstream of an exit from the first channel.

7. The gas turbine engine according to claim 6, wherein the support and cooling arrangement further includes a cooling plate disposed adjacent and parallel to the radially inwardly directed face thereby to form a second channel between the cooling plate and the radially inwardly directed face, wherein the cooling plate includes a plurality of cooling holes, and wherein the gas turbine engine is in use, the plurality of cooling holes form radially outwardly directed jets of cooling fluid from cooling fluid supplied to the cavity, the jets impinging upon and cooling the radially inwardly directed face and cooling fluid from the second channel enters the first channel.

8. The gas and turbine engine according to claim 1, further comprising two retaining pins, the rail includes a raised portion at each end and a depression between the raised portions, and wherein each raised portion includes a hole through which a respective one of the two retaining pins extends.

9. The gas turbine engine according to claim 1, wherein the retaining pin extends through a plurality of holes in the rail and flange part, the form of which is such as to determine a circumferential position of the segment.

10. The gas turbine engine according to claim 1, wherein the retaining pin extends through circumferentially extending slots in the rail and/or flange part thereby to permit adjustment of a circumferential position of the segment.

* * * * *